US005867523A

United States Patent [19]

Wasmund et al.

[11] Patent Number: 5,867,523

[45] Date of Patent: Feb. 2, 1999

[54] ELECTRIC FURNACE WITH CONDUCTIVE HEARTH

[75] Inventors: Bert Orland Wasmund, Milton; Thomas Lai Wai Ma, North York; Nils Walter Voermann, Toronto, all of Canada

[73] Assignee: Hatch Associates Ltd., Mississauga, Canada

[21] Appl. No.: 655,168

[22] Filed: May 28, 1996

[51] Int. Cl.[6] ..... F27D 1/00

[52] U.S. Cl. ..... 373/72; 373/108

[58] Field of Search ..... 373/72.85, 108

[56] References Cited

U.S. PATENT DOCUMENTS

| | | | |
|---|---|---|---|
| 681,107 | 8/1901 | Cowles | 373/72 |
| 1,167,176 | 1/1916 | Highfield | 373/72 |
| 1,287,849 | 12/1918 | Booth | 373/72 |
| 4,204,082 | 5/1980 | Stenkvist | 373/72 |
| 4,336,411 | 6/1982 | Hanas et al. | 373/85 |
| 4,692,930 | 9/1987 | Radke et al. | 373/72 |
| 4,853,941 | 8/1989 | Rappinger et al. | 373/72 |
| 5,052,018 | 9/1991 | Meredith | 373/72 |
| 5,173,920 | 12/1992 | Bochsler et al. | 373/72 |
| 5,237,585 | 8/1993 | Stenkvist | 373/72 |
| 5,297,159 | 3/1994 | Dung et al. | 373/72 |

*Primary Examiner*—Tu Ba Hoang
*Attorney, Agent, or Firm*—Ridout & Maybee

[57] ABSTRACT

An improved return path for electric current through a conductive hearth of a direct current arc furnace is provided by pressing a ring of water cooled copper blocks into the periphery of a sidewall of the hearth of the furnace, the hearth having zones of conductive refractory providing an electrical path between the contents of the furnace of the copper blocks. The hearth is compressed by a tensioned peripheral band which may also support the blocks. The peripheral water cooled copper blocks may be divided into multiple groups, each group connected to one pole of a direct current power supply, the opposite pole of which is connected to a suspended electrode, permitting control of arc deflection.

15 Claims, 2 Drawing Sheets

ELECTRIC FURNACE WITH CONDUCTIVE HEARTH

BACKGROUND OF THE INVENTION

1. Field of the Invention

This invention relates to direct current electric furnaces of the type utilizing an electrode or electrodes extending downwardly into a vessel having a conductive hearth, in the form of an inverted arch constructed of refractories, to provide a return current path.

2. Review of the Art

Existing conducting hearth designs found in DC furnaces include:

multiple courses of conductive refractory brick over a copper plate; conducting steel pins embedded in a rammed refractory over a steel plate; conducting steel fins embedded in refractory over a steel plate; and conducting steel billets embedded in the refractory. All these designs operate with vertical current conduction through the hearth to a DC return power conductor system located beneath the furnace.

The electrically conductive brick design requires multiple courses of refractory brick having a high electrical conductivity. Electrically conductive refractory materials generally have increased thermal conductivity which results in excessive heat transfer out the furnace bottom. The thermal heat conduction together with the significant electrical power losses associated with conductive brick cause increased thermal expansion of the hearth. The expansion creates gaps in the brickwork which fill with metal fingers. The movement of the bricks also causes uneven pressures between brick courses which in turn can alter the distribution of hearth contact resistances. Since the hearth current flows through the paths of lowest resistance, local changes in contact resistance between the conductive brick and copper plate can re-direct hearth current flow. As a consequence, non-uniform current densities are created in the hearth which accelerate uneven brick movement and can eventually cause floating of loosened refractory brick. The uneven current densities also create hot spots which can re-melt frozen metal fingers in the brick. If the molten bath should become superheated, a bottom run out could easily be initiated through a current conducting metal finger in the hearth brick.

The electrical conduction paths of these existing designs are dictated by the hearth brick resistance distribution and hence contact pressure distribution between hearth bricks. Since these forces cannot be controlled in an orderly fashion, the hearth resistance distribution can vary, which in turn, can reduce the maximum current capacity of this design. Since the hearth brick and copper plate are not accessible from outside the furnace, any bottom repairs require a total furnace shutdown.

The electrically conductive steel pins, fins and billet hearth conductors are designed to operate in direct contact with the molten bath. These designs are therefore consumable and require frequent replacement. The conductive steel-refractory hearth assemblies are generally designed for scheduled replacement and require a full shutdown. Bottom conductor replacement also requires that the molten bath be completely tapped out of the furnace. Because the steel pins, fins and billets all require regular replacement, a brick inverted arch hearth, which is not designed for fast or frequent replacement, cannot be used with the steel conductors. Steel pins, fins or billets do not provide the benefits of the inverted brick hearth for smelting operations. These benefits include: a tight refractory lining which resists matte or metal penetration by hot melts or slags; the ability to apply external mechanical compressive forces which maintain the hot bath containment integrity of the hearth; and the ability to use, in non-conductive zones, electrically non-conductive refractory materials which better resist erosion or chemical dissolution by chemical reaction with the hot bath, and reduce heat transfer through the base of the hearth.

In U.S. Pat. No. 3,383,450 (Dillon et al) and U.S. Pat. No. 4,336,411 (Hanas et al) proposals have been made to provide electrodes in the side walls of an arc furnace and a melt ladle respectively, the objective in the first case being to provide auxiliary electrodes to avoid cold spots, while in the second case the application is considerably different from a conventional DC arc furnace. U.S. Pat. No. 4,204,082 (Stenkvist) also discloses a DC arc furnace with an auxiliary side-wall electrode, used only in the early stages of a melt.

U.S. Pat. No. 1,167,176 discloses the use of water cooled electrodes embedded in the hearth of an arc furnace, but very clearly such electrodes cannot be serviced without taking the furnace out of service.

U.S. Pat. Nos. 5,052,018 and 5,199,043 (Meredith) disclose DC arc furnaces with inverted arch under conductive brick hearths, to which current is supplied through an annular conductor surrounding external side walls of the hearth. Such arrangements avoid the necessity for steel or copper conductors beneath the furnace, but do not address the other problems associated with conductive brick hearths and outlined above.

U.S. Pat. No. 3,849,587 (Hatch et al) discloses the use of water cooled copper blocks embedded in the sidewall of a furnace with a view to protecting the refractory sidewall of the furnace from erosion by forming a local layer of frozen melt over the lining.

SUMMARY OF THE INVENTION

We have now found that by embedding fluid, preferably water, cooled blocks, similar to those of U.S. Pat. No. 3,849,587, in the sidewall of the hearth of the furnace rather than in the sidewall of the furnace itself, and utilizing these blocks as electrodes to establish electrical connection to zones of conductive refractory material in the hearth, it is possible to address the problems outlined above. The fluid cooled blocks may be individually replaced without shutting down the furnace, and their cooling effect reduces erosion of the conductive refractory lining by promoting the solidification of molten metal in contact with the lining. The penetration of the blocks into the sidewall of the hearth improves electrical contact as well as protecting the hearth structure from erosion.

The sidewall electrodes formed by the fluid cooled blocks may be connected to one or more individually controlled DC power supplies. The deflection of the arc may then be controlled by individual adjustment of each independent power supply.

Further features of the invention will be apparent from the following description of a prepared embodiment thereof.

IN THE DRAWINGS

DESCRIPTION OF THE PREFERRED EMBODIMENT

Figure 1:
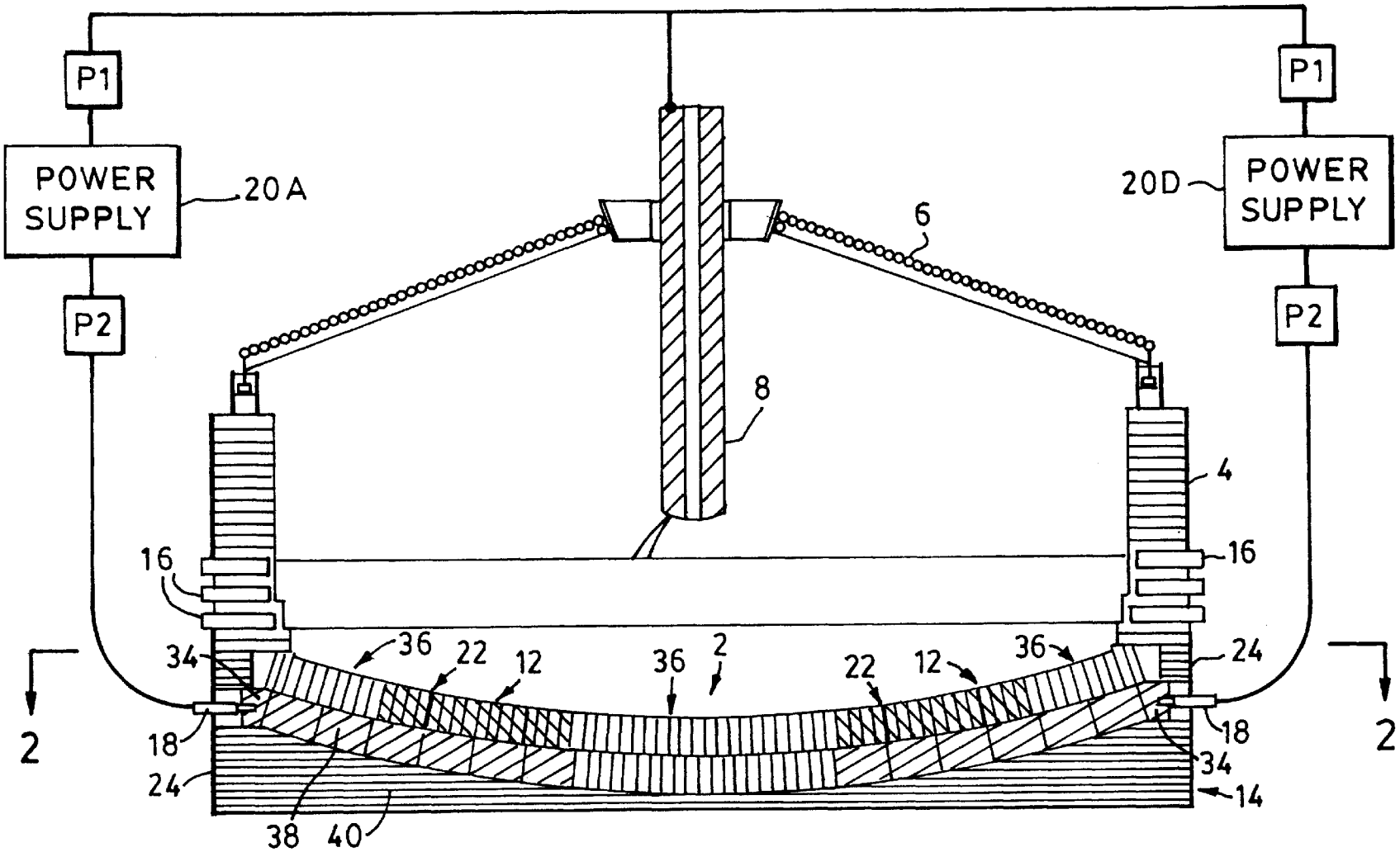
FIG. 1 is a vertical section through an arc furnace incorporating the invention.
Figure 2:
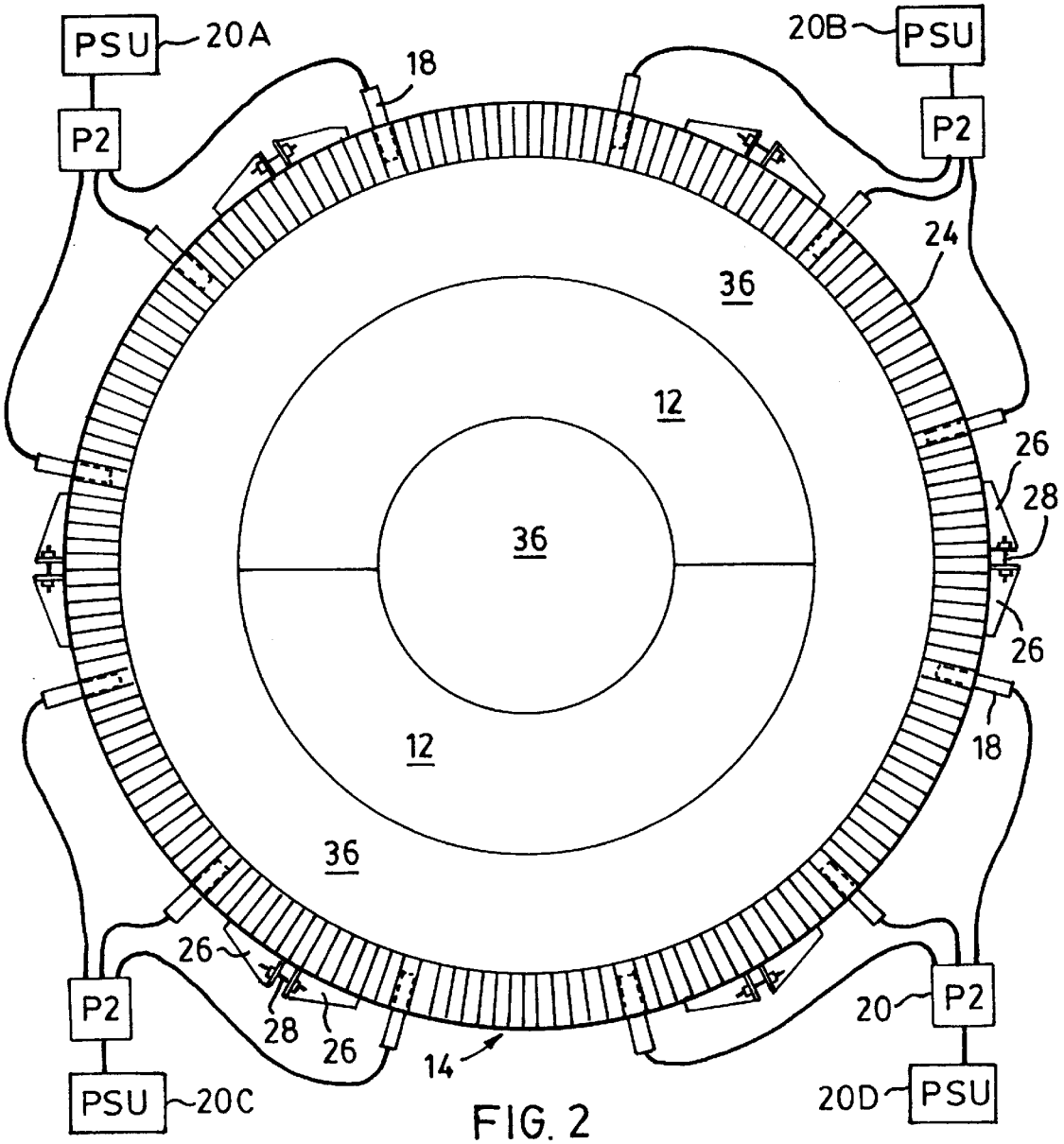
FIG. 2 is an horizontal section through the furnace on the line 2—2 in FIG. 1.

An electric arc furnace is shown in FIGS. 1 and 2, having an inverted arch refractory hearth 2, a sidewall 4, a roof 6, and a negative or positive electrode 8 extending downwardly through the roof from a power clamp and buswork connected to one pole P1 of single or multiple DC electrical supplies 20A, 20B, 20C and 20D. An electrode connected to pole P2 of opposite polarity, is formed by zones 12 of conductive brick laid into insulating brick 36 of the hearth. Conductive brick 38 in a lower course of the hearth completes a conductive path to an external sidewall 14 of the hearth. A lower backup lining 40 may be formed of non-conductive brick, thus improving the thermal and electrical integrity of the furnace. Rather than bricks, other refractory material may be used. The bricks or other refractory in the conductive zones may be rendered conductive by the use of conductive aggregate, or metal filaments or strips, or metal inserts 22 between insulative bricks. In the embodiment shown, the upper sidewall 4 is equipped with water cooled copper blocks 16, which freeze a layer of molten material against the sidewall 4 which protects it from the erosive effect of the melt within the furnace, as described in U.S. Pat. No. 3,849,587.

It is a feature of the present invention that further similar cooled blocks 18 are used to establish electrical contact between a pole P2 of the power supplies and the conductive brick zones in the hearth. Instead of being made of copper, the blocks may be formed of materials such as graphite, steel or nickel, and instead of water, other fluid coolants such as air or oil may be utilized. As shown, the blocks 18 extend into and are held pressed against conductive skew back bricks 34 surrounding the hearth. The water cooled blocks 18 conduct high DC currents out of the hearth while conducting large heat fluxes out the hearth bricks. Not only does this counteract heating of the conductive brick by the passage of current, but it promotes the formation of a protective freeze layer of conductive metal over the hearth, which greatly reduces erosion of the refractory bricks forming the hearth. The brickwork of the hearth is held in controlled compression by an external binding system described further below. The heat withdrawn by the sidewall copper blocks 18 assists in mechanically stabilizing the hearth bricks, which in turn stabilizes the contact pressures between them and thus the electrical resistance between the conductive hearth bricks. This provides well defined current paths through the furnace hearth from the copper blocks, and eliminates the need for electrical buswork beneath the furnace. Further stabilization of the structure and electrical properties of the hearth is provided by the controlled compression.

FIG. 2 shows how four independent power supplies 20A, 20B, 20C, 20D are each connected to groups of 3 sidewall copper blocks. Each power supply controls current flow through a 90° quadrant of the furnace hearth. Deflection of an arc struck within the furnace can be controlled by operating the power supplies with unequal voltage or current.

Multiple power supplies also provide for on-line maintenance of a single power supply or group of copper blocks while the remaining power supplies and copper blocks remain in service. It will be understood of course that the number of power supplies utilized, and the grouping of the blocks serviced by those supplies, may vary. Indeed, only a single supply need be used but of course the advantages associated with the use of multiple supplies will not then be attained.

The installation of the water cooled copper blocks 18 into the sidewall of the hearth improves operating safety by allowing pipework (not shown) for the cooling blocks to be arranged externally of the sidewall of the furnace and away from the bottom of the furnace, which can be supported on a conventional furnace foundation and provided if required with a supplementary hearth air cooling system. The cooling water supply to the copper blocks may also be used to cool the conductive cables or tubes connecting the blocks to the pole P2 of the furnace electrical supply. Likewise, all electrical connections to the cooling blocks 18 can be arranged externally to the sidewall of the hearth, providing improved accessibility and reliability.

If appropriate to the design of the furnace, conductive plates 22 may be incorporated between the bricks of the hearth to improve current flow. These plates will be protected by frozen metal in the same way as the refractory bricks. The conductive zones of the hearth may be rendered suitably conductive by the use of refractories incorporating conductive aggregates, metallic filaments or strips.

Figure 3:
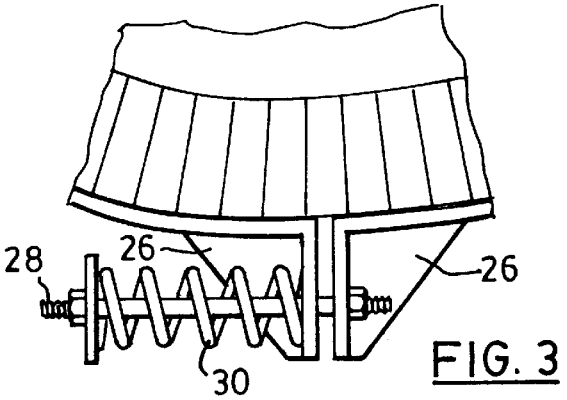
FIG. 3 is a detail showing a modification to connections between compression ring segments shown in FIG. 2.

A further degree of hearth integrity and consistency of electrical conduction through the hearth structure is achieved by surrounding the sidewall of the hearth by a tensioned binding ring or shell 24 formed from multiple segments each provided with external end brackets 26 connected by tension bolts 28 which can be adjusted to maintain a constant compression on the hearth structure. Bridge pieces 32 extend beneath adjacent segments to complete the ring. By loading the bolts with springs 30 as shown in FIG. 3, or by alternative hydraulic or other actuators, tension in the ring 24 can be maintained substantially constant during expansion and contraction of the hearth structure. The ring also provides a convenient means for mounting the blocks 18 and holding them pressed into the blocks 34, although independent springs or fluid actuators may be provided for this latter purpose. While it is known to provide tensioned bindings for the sidewalls of furnaces, we are not aware of such bindings having been utilized to help stabilize the electrically conductive properties of a conductive refractory hearth in a DC arc furnace.

Although shown applied to a cylindrical furnace with a single suspended electrode, the invention is applicable to both cylindrical and rectangular furnace geometries having single or multiple electrodes. In a multiple electrode furnace, one or more DC power supplies may be applicable to each electrode.

We claim:

1. An electric furnace comprising a sidewall and a conductive hearth defining a vessel, the conductive hearth being in the form of an inverted refractory arch incorporating zones of conductive refractory, at least one electrode suspended into the vessel, and external electrical connections to said at least one electrode and said hearth respectively; the external electrical connections to the hearth being multiple peripherally spaced fluid cooled electrodes maintained in intimate electrical contact with a zone of said conductive refractory in a peripheral sidewall of the hearth.

2. An electric furnace according to claim 1, wherein the zones of conductive refractory are rendered conductive by incorporation of at least one of conductive aggregate, metallic filaments, metallic strips, and metallic inserts between non-conductive bricks.

3. An electric furnace according to claim 1, wherein the fluid cooled electrodes are formed of copper.

4. An electric furnace according to claim 1, wherein the cooling fluid is water.

5. An electric furnace according to claim 1, wherein means are provided to bias the fluid cooled electrodes into contact with the sidewall of the hearth.

6. An electric furnace according to claim 1, wherein the hearth refractory comprises multiple courses of refractory material, and the fluid cooled electrodes engage an annular zone of conductive refractory material in a lower course, which contacts a further annular zone of conductive refractory material at the upper surface of the hearth.

7. An electric furnace according to claim 6, including a layer of insulating refractory material below said lower course.

8. An electric furnace according to claim 6, wherein the fluid cooled electrodes engage said zone of conductive bricks through a ring of conductive skew back bricks.

9. An electric furnace according to claim 1, wherein the sidewall of the hearth is surrounded by a tensioned binding.

10. An electric furnace according to claim 9, wherein the binding is formed in segments, and the segments are connected by tensioning means.

11. An arc furnace according to claim 10, wherein the tensioning means include springs to maintain a substantially constant compressive pressure on the hearth structure.

12. An arc furnace according to claim 1, including further fluid cooled blocks in the sidewall of the furnace.

13. An arc furnace according to claim 1, including multiple independently controlled DC power supplies connected to different groups of the peripherally spaced fluid cooled electrodes.

14. An arc furnace comprising a sidewall and a conductive hearth defining a vessel, at least one electrode suspended into the vessel, the hearth being in the form of an inverted refractory dome and incorporating zones of conductive refractory, and a peripheral binding girdling the hearth and maintained under a controlled tension whereby to render more consistent the conductive properties of the hearth.

15. An arc furnace according to claim 11, wherein the binding comprises multiple segments connected by tensioning means.

* * * * *